United States Patent [19]

Zaitoun

[11] Patent Number: 4,953,491

[45] Date of Patent: Sep. 4, 1990

[54] TEMPORARY, REUSABLE, MOVABLE HULL PATCH FOR A DAMAGED OIL TANKER

[76] Inventor: Hanna Zaitoun, 358 89th St., Brooklyn, N.Y. 11209

[21] Appl. No.: 445,407

[22] Filed: Dec. 4, 1989

[51] Int. Cl.[5] ..... B63B 43/16

[52] U.S. Cl. ..... 114/229; 114/227

[58] Field of Search ..... 114/227, 228, 229, 47

[56] References Cited

U.S. PATENT DOCUMENTS

| | | | |
|---|---|---|---|
| 1,511,155 | 10/1924 | Blumberg | 114/229 |
| 1,550,144 | 8/1925 | Blumberg | 114/229 |
| 2,288,271 | 6/1942 | Dickey | 114/227 |
| 4,161,155 | 7/1979 | Cloutier | 114/229 |

*Primary Examiner*—Sherman D. Basinger
*Assistant Examiner*—Thomas J. Brahan
*Attorney, Agent, or Firm*—Michael I. Kroll

[57] ABSTRACT

A temporary, reusable, movable hull patch for a damaged oil tanker hull having sides is disclosed. The hull patch comprising an upper track being rigidly affixed to each side of the hull, a lower track being rigidly affixed to each side of the hull and spaced a distance from the upper track, a body portion, four flaps framing the body portion and having four free edges, respectively, containing a resilient material so as to provide a good seal between the hull and the four flaps, the four flaps having a sealed position and an unsealed position, four pivots for pivotally connecting the four flaps to the body portion, respectively, four hydraulic cylinders for moving the four flaps from the sealed position to the unsealed position and vice versa, and two trucks attached to and riding on the lower track and the upper track.

6 Claims, 1 Drawing Sheet

TEMPORARY, REUSABLE, MOVABLE HULL PATCH FOR A DAMAGED OIL TANKER

BACKGROUND OF THE INVENTION

1. Field of the Invention

The present invention relates to an oil tanker.

More particularly, the present invention relates to a temporary, reusable, movable, hull patch for a damaged oil tanker.

2. Description of the Prior Art

Numerous innovations for repairing a damaged oil tanker hull have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a temporary, reusable, movable hull patch for a damaged oil tanker that avoids the disadvantages of the prior art.

More particularly, it is an object of the present invention to provide a temporary, reusable, movable hull patch for a damaged oil tanker, that reduces environmental pollution, reduces the cost of clean-up, reduces the cost of the lost edible fish and other animals, reduces the cost of the oil lost, and reduces the appeal lost in the spill area.

In keeping with these objects, and with others which will become apparent hereinafter, one feature of the present invention resides, briefly stated, in a temporary, reusable, movable hull patch for a damaged oil tanker hull, having sides, the hull patch comprising an upper track being ridigly affixed to each side of the hull, a lower track being rigidly affixed to each side of the hull and spaced a distance from the upper track, a body portion, four flaps framing the body portion and having four free edges, respectively, containing a resilient material so as to provide a good seal between the hull and the four flaps, the four flaps having a sealed position and an unsealed position, four pivots for pivotally connecting the four flaps to the body portion, respectively, four hydraulic cylinders for moving the four flaps from the sealed position to the unsealed position and vice versa, and two trucks attached to and riding on the lower track and the upper track.

When the temporary, reusable, movable hull patch for a damaged oil tanker is designed in accordance with the present invention, a damage anywhere on the sides of the hull can be temporarily repaired.

In accordance with another feature of the present invention, each of the two trucks comprise a flat slim body bar having an upper end with an upper hole and a lower end with a lower hole disposed in the upper end and the lower end of each of the flat slim body bars.

Another feature of the present invention is that each of the two trucks further comprise an upper shaft and a lower shaft, the upper shaft being rigidly affixed in the upper hole and the lower shaft being rigidly affixed in the lower hole.

Yet another feature of the present invention is that each of the two trucks still further comprise an upper roller rotationally mounted to the upper shaft and a lower roller rotationally mounted to the lower shaft.

Still another feature of the present invention is that the lower flap contains three throughbores used as accesses when residue in the patch and/or hull is vacuumed up.

Yet still another feature of the present invention is that it further comprises a conventional motor for moving to the damaged area.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figures 1, 2, 3, 4, 5:
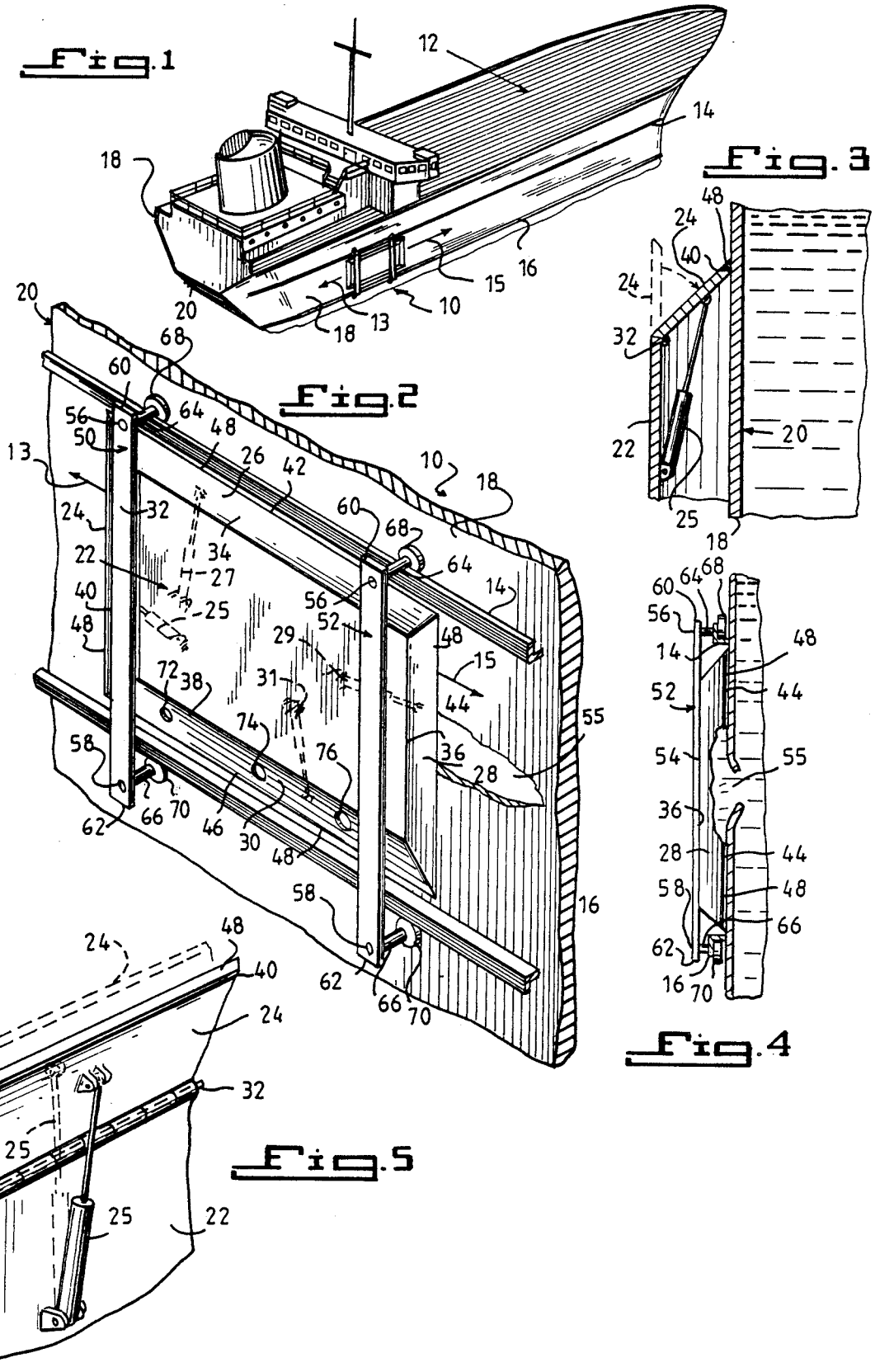
FIG. 1 is a perspective view of an oil tanker equipped with the reusable, movable hull patch for an oil tanker, of the present invention.
FIG. 2 is a perspective view of the temporary, reusable, movable hull patch for a damaged oil tanker, which is moving into position to seal the damage to the tanker's hull.
FIG. 3 is a cross-sectional view, showing a hydraulic cylinder moving a flap from the unsealed position, shown in phantom, to the sealed position.
FIG. 4 is a cross-sectional view showing the temporary, reusable, movable hull patch for a damaged oil tanker of the present invention, sealing a hole in the tanker's hull.
FIG. 5 is a cross-sectional perspective view showing a hydraulic cylinder moving a flap from the unsealed position, shown in phantom, to the sealed position.

10—temporary, reusable, movable hull patch for a damaged oil tanker
12—oil tanker
13—arrow
14—upper track
15—arrow
16—lower track
18—sides of the oil tanker 12
20—hull of the oil tanker 12
22—body portion
24—first flap
25—first hydraulic cylinder
26—second flap
27—second hydraulic cylinder
28—third flap
29—third hydraulic cylinder
30—fourth flap
31—fourth hydraulic cylinder
32—first pivot point
34—second pivot point
36—third pivot point
38—fourth pivot point
40—first free edge
42—second free edge
44—third free edge
46—fourth free edge
48—resilient material
50—first truck
52—second truck
54—flat sling body bar
55—damaged area
56—upper holes 58—lower holes
60—upper ends
62—lower ends
64—upper shafts
66—lower shafts
68—upper rollers
70—lower rollers
72—first throughbore
74—second throughbore
76—third throughbore

DETAILED DESCRIPTION OF THE PREFERRED EMBODIMENT

Referring now to FIG. 1, the temporary, reusable, movable hull patch for a damaged oil tanker of the present invention is shown generally at 10, mounted to an oil tanker 12. The temporary, reusable, movable hull patch 10 for a damaged oil tanker rides in the direction of arrows 13 and 15, on an upper track 14 and a lower track 16. The upper track 14 and the lower track 16 are rigidly affixed to each side 18 of the hull 20.

The temporary, reusable, movable hull patch 10 for a damaged oil tanker is shown in greater detail in FIGS. 2 and 4.

As seen in FIGS. 2 and 4, the temporary, reusable, movable hull patch 10 for a damaged oil tanker includes a body portion 22 framed by a first flap 24, a second flap 26, a third flap 28, and a fourth flap 30 via a pivot point 32, a second pivot point 34, a third pivot point 36, and a fourth pivot point 38, respectively. A free edge 40, a second free edge 42, a third free edge 44, and a fourth free end 46, respectively contain a resilient material 48 so as to provide a good seal between the hull 20 and the first flap 24, the second flap 26, the third flap 28, and fourth flap 30, respectively.

As shown in FIGS. 3 and 5, the first flap 24, the second flap 26, the third flap 28, and the fourth flap 30 move from an unsealed position to a sealed position by the use of the first hydraulic cylinder 25, the second hydraulic cylinder 27, the third hydraulic cylinder 29, and the fourth hydraulic cylinder 31. A first truck 50 and a second truck 52 are attached to and ride on the upper track 14 and the lower track 16, to the damaged area 55.

The first truck 50 and the second truck 52 each include a flat slim body bar 54 having upper holes 56 and lower holes 58, in their upper ends 60 and their lower ends 62, respectively. Upper shafts 64 and lower shafts 66 are rigidly affixed in the upper hole 56 and the lower hole 58, respectively.

The upper rollers 68 and the lower rollers 70 rotate on the upper shafts 64 and the lower shafts 66, respectively, as the repair traverses the upper track 14 and the lower track 16.

The fourth flap 30 contains a first three throughbore 72, a second throughbore 74, and a third throughbore 76 that are used as access means if there is any residue that must be vacuumed up.

A conventional motor (not shown), moves the temporary, reusable, movable hull patch 10 for a damaged oil tanker 12 back and forth on the upper track 14 and on the lower track 16 until the temporary, reusable, movable hull patch 10 for a damaged oil tanker is over the damaged area 55. At this time the first hydraulic cylinder 25, the second hydraulic cylinder 27, the third hydraulic cylinder 29, and fourth hydraulic cylinder 38 retract and the flaps 24, 26, 28, and 30 surround the damaged area 55 where, via the resilient material 48, the damaged area 55 is sealed.

It will be understood that each of the elements described above, or two or more together, may also find a useful application in other types of constructions differing from the type described above.

While the invention has been illustrated and described as embodied in a hull patch for a damaged oil tanker, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A temporary, reusable, movable hull patch for a damaged oil tanker hull having sides, said hull patch, comprising:

(a) an upper track being ridigly affixed to each side of the hull;

(b) a lower track being rigidly affixed to each side of the hull and spaced a distance below said upper track;

(c) a body portion;

(d) four flaps framing said body portion and having four free edges, respectively, and containing a resilient material so as to provide a good seal between said hull and said four flaps, said four flaps having a sealed position and an unsealed position;

(e) four pivots for pivotally connecting said four flaps to said body porton, respectively;

(f) four hydraulic cylinders for moving said four flaps from said sealed position to said unsealed position and vice versa; and (g) two trucks attached to and riding on said lower track and said upper track.

2. A hull patch as defined in claim 1, wherein each of said two trucks include a flat slim body bar having an upper end with an upper hole and a lower end with a lower hole disposed in said upper end and said lower end of said each of said flat slim body bars.

3. A hull patch as defined in claim 2, wherein said each of said two trucks further include an upper shaft and a lower shaft, said upper shafts being rigidly affixed in said upper holes and said lower shafts being rigidly affixed in said lower holes.

4. A hull patch as defined in claim 3, wherein said each of said two trucks still further include upper rollers rotationally mounted to said upper shafts and lower rollers rotationally mounted to said lower shafts.

5. A hull patch as defined in claim 4, wherein said lower flap contains three throughbores used as an access when residue is to be vacuumed up.

6. A hull patch as defined in claim 5; further comprising a conventional motor for moving to the damaged area.

* * * * *